US008958723B2

(12) United States Patent
Liu

(10) Patent No.: US 8,958,723 B2
(45) Date of Patent: Feb. 17, 2015

(54) SYSTEMS AND METHODS FOR INK-BASED DIGITAL PRINTING USING LIQUID IMMERSION DEVELOPMENT

(71) Applicant: Xerox Corporation, Norwalk, CT (US)

(72) Inventor: Chu-heng Liu, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 154 days.

(21) Appl. No.: 13/631,989

(22) Filed: Sep. 29, 2012

(65) Prior Publication Data

US 2014/0093284 A1 Apr. 3, 2014

(51) Int. Cl.
*G03G 15/10* (2006.01)

(52) U.S. Cl.
CPC ..... *G03G 15/10* (2013.01); *G03G 15/104* (2013.01)
USPC ..... 399/248

(58) Field of Classification Search
CPC ..... G03G 15/10
USPC ..... 399/244
See application file for complete search history.

(56) References Cited

U.S. PATENT DOCUMENTS

| | | | | |
|---|---|---|---|---|
| 3,741,118 | A * | 6/1973 | Carley | 101/451 |
| 3,800,699 | A * | 4/1974 | Carley | 101/147 |
| 3,877,372 | A * | 4/1975 | Leeds | 101/465 |
| 3,986,452 | A * | 10/1976 | Dahlgren | 101/148 |
| 6,146,798 | A * | 11/2000 | Bringans et al. | 430/49.1 |
| 7,020,355 | B2 * | 3/2006 | Lahann et al. | 385/16 |
| 7,100,503 | B2 * | 9/2006 | Wiedemer et al. | 101/466 |
| 8,347,787 | B1 * | 1/2013 | Stowe et al. | 101/450.1 |
| 8,586,277 | B1 * | 11/2013 | Veres et al. | 430/118.2 |
| 2004/0011234 | A1 * | 1/2004 | Figov et al. | 101/488 |
| 2007/0199457 | A1 * | 8/2007 | Cyman et al. | 101/211 |
| 2007/0199458 | A1 * | 8/2007 | Cyman et al. | 101/211 |
| 2007/0199459 | A1 * | 8/2007 | Cyman et al. | 101/211 |
| 2007/0199460 | A1 * | 8/2007 | Cyman et al. | 101/211 |
| 2007/0199461 | A1 * | 8/2007 | Cyman et al. | 101/211 |
| 2007/0199462 | A1 * | 8/2007 | Cyman et al. | 101/211 |
| 2012/0103219 | A1 * | 5/2012 | Stowe et al. | 101/450.1 |

(Continued)

FOREIGN PATENT DOCUMENTS

| | | | | |
|---|---|---|---|---|
| EP | 2574459 | * | 4/2013 | B41C 1/10 |

OTHER PUBLICATIONS

Place of Search: Hague; EP12178607, European Search Report, 31/07/2012; Oct. 24, 2013.*

*Primary Examiner* — Clayton E Laballe
*Assistant Examiner* — Kevin Butler
(74) *Attorney, Agent, or Firm* — Ronald E. Prass, Jr.; Prass LLP

(57) ABSTRACT

Ink-based digital printing systems useful for ink printing include a photoreceptor layer configured to receive a layer of liquid immersion fluid. The liquid immersion fluid includes dampening fluid, dispersed solid particles, and charge directors that impart charge to the solid particles. The photoreceptor surface is charged to a uniform potential, and selectively discharged using an ROS according to image data to form an electrostatic latent image. The charged liquid immersion fluid adheres to portions of the photoreceptor surface according to the electrostatic latent image to form a liquid immersion fluid image. The fluid portion of the liquid immersion fluid image is partially transferred to an imaging member and/or transfer member to form a dampening fluid image, either or both of which may be electrically biased. The dampening fluid image is inked on the transfer member, and the resulting ink image transferred to a recording medium.

16 Claims, 5 Drawing Sheets

(56) References Cited

U.S. PATENT DOCUMENTS

2012/0103221 A1* 5/2012 Stowe et al. ..... 101/483
2014/0060356 A1* 3/2014 Lestrange et al. ..... 101/365
2014/0093284 A1* 4/2014 LIU, Chu-heng ..... 399/248

* cited by examiner

SYSTEMS AND METHODS FOR INK-BASED DIGITAL PRINTING USING LIQUID IMMERSION DEVELOPMENT

RELATED APPLICATIONS

This application is related to co-pending U.S. application Ser. No. 13/599,004, titled SYSTEMS AND METHODS FOR INK-BASED DIGITAL PRINTING USING DAMPENING FLUID IMAGING MEMBER AND IMAGE TRANSFER MEMBER, the disclosure of which is incorporated by reference herein in its entirety; and co-pending U.S. application Ser. No. 13/599,380, titled SYSTEMS AND METHODS FOR INK-BASED DIGITAL PRINTING USING IMAGING MEMBER AND IMAGE TRANSFER MEMBER, the disclosure of which is incorporated by reference herein in its entirety.

FIELD OF DISCLOSURE

The disclosure relates to ink-based digital printing. In particular, the disclosure relates to methods and systems for ink-based digital printing with a printing system having an imaging member and an image transfer member that receives a liquid immersion fluid image from the imaging member.

BACKGROUND

Related art ink-based digital printing systems, or variable data lithography systems configured for digital lithographic printing, include an imaging system for laser patterning a layer of dampening fluid applied to an imaging member. The imaging system includes a high power laser for emitting light energy. The imaging member must include a costly reimageable surface layer, such as a plate or blanket that is capable of absorbing light energy, among other demands required for image production. While high print speeds and reduced system and operating costs are generally desirable, print speeds achieved using related art ink-based digital printing systems are limited by the laser imaging process.

SUMMARY

Related art ink-based digital printing systems use high power lasers for laser patterning that require an imaging member having a plate that is costly and subject to stringent design requirements, including suitability for dampening fluid and ink interactions. Systems have been developed for metering dampening fluid onto an imaging member, patterning dampening fluid according to image data using a laser imager, and transferring the dampening fluid image to a separate member for inking.

Although such systems reduce materials risks significantly by enabling separation of functionalities of the related art digital architecture lithography imaging plate, expensive high power lasers are required, which present challenging technical problems. Systems, methods, and liquid immersion fluid in accordance with embodiments are provided for producing a dampening fluid image without the requirement for a high power laser. Liquid immersion development is known for use in liquid toner xerography. Contrary to liquid toner xerography, the liquid immersion fluid of embodiments includes a dispersed solid (similar to liquid toner in liquid xerography) that facilitates carriage and delivery of the fluid (e.g., dampening fluid such as fountain solution) to imaging and transfer members in an image-wise fashion. The solid particles of the liquid immersion fluid may be electrically biased or charged to cause the particles to adhere to portions of the imaging member having complementary charge. Accordingly, the imaging member may be charged to attract and retain liquid immersion fluid containing the charged particles. For example, a raster output scanner ("ROS") may configured for exposing a uniformly charged photoreceptor imaging member to selectively discharge portions thereof to develop an electrostatic latent image. Charged particles and associated fountain solution of the immersion liquid may be caused to adhere to the imaging member to form an immersion liquid image that corresponds to the electrostatic latent image. Systems, methods, and liquid immersion fluid in accordance with embodiments enable re-use of dispersed solid particles, and high speed printing of high resolution images.

In an embodiment, ink-based digital printing systems useful for ink printing may comprise an imaging member configured for carrying a liquid immersion fluid image on the imaging member; and a transfer member, the imaging member and the transfer member forming a fluid image loading nip.

Systems may comprise a liquid immersion fluid metering system, the liquid immersion fluid system being configured to present a uniform layer of liquid immersion fluid to a surface of the imaging member. Systems may comprise the liquid immersion fluid of the liquid immersion fluid image having dampening fluid and solid particles, the system comprising the imaging member and the transfer member being configured to transfer at least a portion of the dampening fluid of the liquid immersion fluid image to a surface of the transfer member at the fluid image loading nip to form a dampening fluid image on the transfer member surface.

Systems may comprise the liquid immersion fluid comprising a dampening fluid; solid particles dispersed in the dampening fluid; and a charge director for imparting charge to the solid particles, wherein at least one of the surface of the imaging member and a surface of the transfer member is electrically biased for retaining the solid particles on the imaging member surface.

The immersion fluid may comprise a dampening fluid selected from the group consisting essentially of silicone fluids (including D4, D5, O520, O530), Isopar fluids; and solid particles, the solid particles being dispersed in the dampening fluid. The immersion fluid may comprise charged solid particles for causing the fluid to adhere to the imaging member surface according to the latent image to form the immersion fluid image.

Systems may include an inking system configured to apply ink to a fluid image on the surface of the transfer member for developing the fluid image. In an embodiment, systems may include the imaging member being a photoreceptor, and the immersion fluid image being formed on the imaging member according to an electrostatic latent image formed on the imaging member.

In an embodiment, systems may include a photoreceptor member, the photoreceptor member being configured for forming an electrostatic latent image on a surface of the photoreceptor member, the photoreceptor member and the imaging member being configured to form a solid particle transfer nip for transfer of solid particles from the imaging member to the photoreceptor member according to the electrostatic latent image.

In an embodiment, systems may include a liquid immersion fluid metering system for presenting liquid immersion fluid to a surface of the imaging member, the liquid immersion fluid comprising the solid particles dispersed in dampening fluid. The immersion fluid may further comprise charged solid particles for causing the charged particles to adhere to the photoreceptor according to the latent image to form a immersion fluid image on the imaging member.

Systems may comprise a raster output scanner imager, the imager being configured to expose a surface of an imaging member to selectively discharge portions of the imaging member according to image data to form an electrostatic latent image.

Systems may comprise a raster output scanner imager, the imager being configured to expose a surface of the photoreceptor to selectively discharge portions of the photoreceptor according to image data to form an electrostatic latent image.

Systems may include an inking system configured to apply ink to a fluid image on the surface of the transfer member for developing the fluid image. In systems, at least one of the imaging member and the transfer member being electrically biased.

A liquid immersion fluid for metering onto on a photoreceptor and/or imaging member surface is provided, comprising a dampening fluid; a plurality of solid particles, the solid particles being dispersed in the dampening fluid; and charge directors for imparting charge to the solid particles.

Methods of an embodiment may include a method of ink-based digital printing using liquid immersion fluid, comprising forming a liquid immersion fluid image on an imaging member, the liquid immersion fluid comprising dampening fluid and solid particles dispersed in the dampening fluid; and transferring a portion of a dampening fluid of the immersion fluid image to a transfer member at a fluid image loading nip formed by the transfer member and the imaging member.

Methods may include forming an electrostatic latent image on a surface of the imaging member; and presenting liquid immersion fluid to the imaging member surface to form a fluid image according to the latent image.

Methods may include forming an electrostatic latent image on a surface of a photoreceptor forming a solid particle transfer nip with the imaging member; presenting liquid immersion fluid to the imaging member to form a uniform layer of liquid immersion fluid; and transferring at least a portion of the solid particles of the uniform layer to the photoreceptor at the solid particle transfer nip to form the liquid immersion fluid image on the imaging member.

Exemplary embodiments are described herein. It is envisioned, however, that any system that incorporates features of apparatus and systems described herein are encompassed by the scope and spirit of the exemplary embodiments.

DETAILED DESCRIPTION

Figure 1:
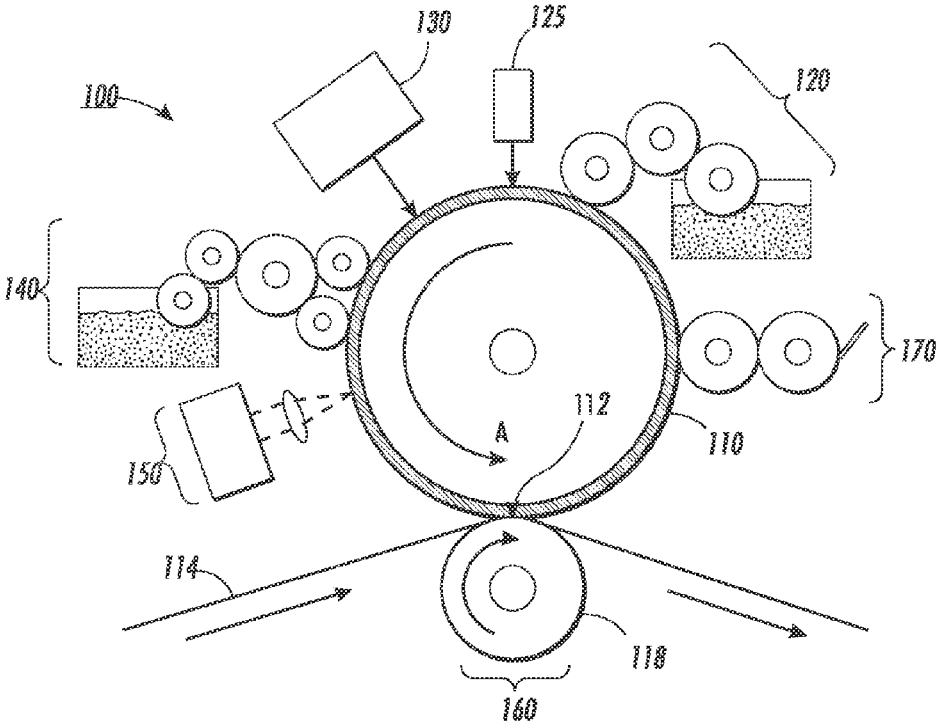
FIG. 1 RELATED ART
FIG. 1 shows a diagrammatical view of a related art digital architecture printing system.

Exemplary embodiments are intended to cover all alternatives, modifications, and equivalents as may be included within the spirit and scope of the apparatus and systems as described herein.

Reference is made to the drawings to accommodate understanding of systems and methods for ink-based digital printing using an imaging member and a transfer member and liquid immersion fluid. In the drawings, like reference numerals are used throughout to designate similar or identical elements. The drawings depict various embodiments of illustrative systems and methods for ink-based digital printing using an imaging member and a transfer member.

Related art ink-based digital printing systems that use high power lasers for laser patterning dampening fluid on an imaging plate can be costly and have limited print speeds. U.S. patent application Ser. No. 13/095,714 (the 714 Application), which is commonly assigned and the disclosure of which is incorporated by reference herein in its entirety, proposes systems and methods for providing variable data lithographic and offset lithographic printing or image receiving medium marking. The systems and methods disclosed in the 714 Application are directed to improvements on various aspects of previously-attempted variable data imaging lithographic marking concepts based on variable patterning of dampening fluids to achieve effective truly variable digital data lithographic printing.

According to the 714 Application, a reimageable surface is provided on an imaging member, which may be a drum, plate, belt or the like. The reimageable surface may be composed of, for example, a class of materials commonly referred to as silicones, including polydimethylsiloxane (PDMS) among others. The reimageable surface may be formed of a relatively thin layer over a mounting layer, a thickness of the relatively thin layer being selected to balance printing or marking performance, durability and manufacturability.

The 714 Application describes an exemplary variable data lithography system 100 for ink-based digital printing, such as that shown, for example, in FIG. 1. A general description of the exemplary system 100 shown in FIG. 1 is provided here. Additional details regarding individual components and/or subsystems shown in the exemplary system 100 of FIG. 1 may be found in the 714 Application.

As shown in FIG. 1, the exemplary system 100 may include an imaging member 110. The imaging member 110 in the embodiment shown in FIG. 1 is a drum, but this exemplary depiction should not be interpreted so as to exclude embodiments wherein the imaging member 110 includes a plate or a belt, or another now known or later developed configuration. The imaging member 110 is used to apply an ink image to an image receiving media substrate 114 at a transfer nip 112. The transfer nip 112 is formed by an impression roller 118, as part of an image transfer mechanism 160, exerting pressure in the direction of the imaging member 110. Image receiving medium substrate 114 should not be considered to be limited to any particular composition such as, for example, paper, plastic, or composite sheet film. The exemplary system 100 may be used for producing images on a wide variety of image receiving media substrates. The 714 Application also explains the wide latitude of marking (printing) materials that may be used, including marking materials with pigment densities greater than 10% by weight. As does the 714 Application, this disclosure will use the term ink to refer to a broad range of printing or marking materials to include those which are commonly understood to be inks, pigments, and other materials which may be applied by the exemplary system 100 to produce an output image on the image receiving media substrate 114.

The 714 Application depicts and describes details of the imaging member 110 including the imaging member 110 being comprised of a reimageable surface layer formed over a structural mounting layer that may be, for example, a cylindrical core, or one or more structural layers over a cylindrical core.

The exemplary system 100 includes a dampening fluid subsystem 120 generally comprising a series of rollers, which may be considered as dampening rollers or a dampening unit, for uniformly wetting the reimageable surface of the imaging member 110 with dampening fluid. A purpose of the dampening fluid subsystem 120 is to deliver a layer of dampening fluid, generally having a uniform and controlled thickness, to the reimageable surface of the imaging member 110. As indicated above, it is known that the dampening fluid may comprise mainly water optionally with small amounts of isopropyl alcohol or ethanol added to reduce surface tension as well as to lower evaporation energy necessary to support subsequent laser patterning, as will be described in greater detail below. If the dampening fluid is a fountain solution, small amounts of certain surfactants may be added to the fountain solution. Alternatively, other suitable dampening fluids may be used to enhance the performance of ink based digital lithography systems. Suitable dampening fluids are disclosed, by way of example, in U.S. patent application Ser. No. 13/284,114, titled DAMPENING FLUID FOR DIGITAL LITHOGRAPHIC PRINTING, the disclosure of which is incorporated herein by reference in its entirety.

Once the dampening fluid is metered onto the reimageable surface of the imaging member 110, a thickness of the dampening fluid may be measured using a sensor 125 that may provide feedback to control the metering of the dampening fluid onto the reimageable surface of the imaging member 110 by the dampening fluid subsystem 120.

Once a precise and uniform amount of dampening fluid is provided by the dampening fluid subsystem 120 on the reimageable surface of the imaging member 110, and optical patterning subsystem 130 may be used to selectively form a latent image in the uniform dampening fluid layer by imagewise patterning the dampening fluid layer using, for example, laser energy. Typically, the dampening fluid will not absorb the optical energy (IR or visible) efficiently. The reimageable surface of the imaging member 110 should ideally absorb most of the laser energy (IR or visible) emitted from the optical patterning subsystem 130 close to the surface to minimize energy wasted in heating the dampening fluid and to minimize lateral spreading of heat in order to maintain a high spatial resolution capability. Alternatively, an appropriate radiation sensitive component may be added to the dampening fluid to aid in the absorption of the incident radiant laser energy. While the optical patterning subsystem 130 is described above as being a laser emitter, it should be understood that a variety of different systems may be used to deliver the optical energy to pattern the dampening fluid.

The mechanics at work in the patterning process undertaken by the optical patterning subsystem 130 of the exemplary system 100 are described in detail with reference to FIG. 5 in the 714 Application. Briefly, the application of optical patterning energy from the optical patterning subsystem 130 results in selective evaporation of portions of the layer of dampening fluid.

Following patterning of the dampening fluid layer by the optical patterning subsystem 130, the patterned layer over the reimageable surface of the imaging member 110 is presented to an inker subsystem 140. The inker subsystem 140 is used to apply a uniform layer of ink over the layer of dampening fluid and the reimageable surface layer of the imaging member 110. The inker subsystem 140 may use an anilox roller to meter an offset lithographic ink onto one or more ink forming rollers that are in contact with the reimageable surface layer of the imaging member 110. Separately, the inker subsystem 140 may include other traditional elements such as a series of metering rollers to provide a precise feed rate of ink to the reimageable surface. The inker subsystem 140 may deposit the ink to the pockets representing the imaged portions of the reimageable surface, while ink on the unformatted portions of the dampening fluid will not adhere to those portions.

The cohesiveness and viscosity of the ink residing in the reimageable layer of the imaging member 110 may be modified by a number of mechanisms. One such mechanism may involve the use of a rheology (complex viscoelastic modulus) control subsystem 150. The rheology control system 150 may form a partial crosslinking core of the ink on the reimageable surface to, for example, increase ink cohesive strength relative to the reimageable surface layer. Curing mechanisms may include optical or photo curing, heat curing, drying, or various forms of chemical curing. Cooling may be used to modify rheology as well via multiple physical cooling mechanisms, as well as via chemical cooling.

The ink is then transferred from the reimageable surface of the imaging member 110 to a substrate of image receiving medium 114 using a transfer subsystem 160. The transfer occurs as the substrate 114 is passed through a nip 112 between the imaging member 110 and an impression roller 118 such that the ink within the voids of the reimageable surface of the imaging member 110 is brought into physical contact with the substrate 114. With the adhesion of the ink having been modified by the rheology control system 150, modified adhesion of the ink causes the ink to adhere to the substrate 114 and to separate from the reimageable surface of the imaging member 110. Careful control of the temperature and pressure conditions at the transfer nip 112 may allow transfer efficiencies for the ink from the reimageable surface of the imaging member 110 to the substrate 114 to exceed 95%. While it is possible that some dampening fluid may also wet substrate 114, the volume of such a dampening fluid will be minimal, and will rapidly evaporate or be absorbed by the substrate 114.

In certain offset lithographic systems, it should be recognized that an offset roller, not shown in FIG. 1, may first receive the ink image pattern and then transfer the ink image pattern to a substrate according to a known indirect transfer method.

Following the transfer of the majority of the ink to the substrate 114, any residual ink and/or residual dampening fluid must be removed from the reimageable surface of the imaging member 110, preferably without scraping or wearing that surface. An air knife 175 may be employed to remove residual dampening fluid. It is anticipated, however, that some amount of ink residue may remain. Removal of such remaining ink residue may be accomplished through use of some form of cleaning subsystem 170. The 714 Application describes details of such a cleaning subsystem 170 including at least a first cleaning member such as a sticky or tacky member in physical contact with the reimageable surface of the imaging member 110, the sticky or tacky member removing residual ink and any remaining small amounts of surfactant compounds from the dampening fluid of the reimageable surface of the imaging member 110. The sticky or tacky member may then be brought into contact with a smooth roller to which residual ink may be transferred from the sticky or tacky member, the ink being subsequently stripped from the smooth roller by, for example, a doctor blade.

The 714 Application details other mechanisms by which cleaning of the reimageable surface of the imaging member 110 may be facilitated. Regardless of the cleaning mechanism, however, cleaning of the residual ink and dampening fluid from the reimageable surface of the imaging member 110 is essential to preventing ghosting. Once cleaned, the reimageable surface of the imaging member 110 is again presented to the dampening fluid subsystem 120 by which a fresh layer of dampening fluid is supplied to the reimageable surface of the imaging member 110, and the process is repeated.

Related art variable data digital lithography has attracted attention in producing truly variable digital images in a lithographic image forming system. The above-described architecture combines the functions of the imaging plate and potentially a transfer blanket into a single imaging member 110 that must have a light absorptive surface.

Related art ink-based digital printing systems having a high power imaging laser are costly. The high power laser imager is costly, and the imaging member must include a costly reimageable plate or surface layer that is subject to numerous design constraints. For example, a related art imaging member must include a re-imageable plate, blanket, or surface layer that is capable of absorbing light energy. The related art imaging plate must satisfy requirements including: enabling inking and release of an ink image; conformability for facilitating transfer of ink images to a wide variety of substrates; temperature tolerance; capability of IR absorption by incorporating, for example, carbon or iron oxide such as iron (III) oxides; enabling surface wetting suitable for ink/plate/dampening fluid interactions; having suitable surface texture configured for pinning of dampening fluid after laser imaging or patterning; capable of maintaining the above requirements and spatial uniformity for prolonged periods of time, e.g., tens of thousands of impressions or longer.

In particular, a related art imaging plate must be 1) configured to accept ink from an inker and enable nearly 100% release of the accepted ink at an ink transfer nip. The imaging member must be 2) conformable for enabling printing on a variety of substrates including paper, plastics, and substrates suitable for packaging. The imaging plate must be 3) configured to tolerate temperatures of greater than 200° C. to accommodate laser patterning. The imaging plate must be 4) configured to absorb IR light, and may incorporate carbon black or ferric oxide in a body of the plate. For example, to minimize absorption depth, the concentration of IR absorber should be high, e.g., 10%. The imaging plate must be 5) configured for surface wetting for dampening fluid, ink, and plate interactions; and the imaging plate must be 6) configured to have a surface texture.

A dampening fluid image, after laser patterning, is unstable. The surface tension of the fluid tends to reshape the edges/corners of the image after the removal of the dampening fluid by the laser power. As a result, an image defect known as pull-back (excessive edge reshaping after laser patterning) can occur and image resolution and image fidelity are reduced. A fine surface texture is important for pinning dampening fluid—after laser patterning. This is particularly challenging during laser exposure when the dampening fluid is subject to an extreme temperature gradient. Additionally, surface texture is important for the inking process. A smooth plate surface without texture may cause various solid and halftone uniformity problems. Plasma etching of the plate surface has been identified as a suitable texturing method. Plasma etching is not, however, effective for all materials. Further, plasma etching can expose the IR absorber embedded in the plate.

Further, the imaging plate must 7) satisfy miscibility requirements between the imaging plate and various chemical components in the dampening fluid and ink. The imaging plate must be 8) wear resistant, maintaining requirements 1-7 enumerated above over a long period of time. This is difficult at least because many of requirements 1-7 relate to surface properties of the plate, which also must be constructed to withstand constant heating and pressure cycles. Failure modes include surface wear, leaching of IR absorber from the imaging plate bulk through the surface of the plate, etc.

Systems and methods of embodiments separate imaging plate functionality, and include an imaging member and a transfer member. The imaging member and the transfer member may be rolls or cylinders. The imaging member may be configured in a printing system to receive a dampening fluid comprising a liquid immersion fluid. The liquid immersion fluid may include, for example, solid particles dispersed in fluid. The solid particles function to carry or deliver the fluid to imaging and transfer members. In particular, a liquid immersion fluid in accordance with embodiments may comprise a dampening fluid such as a fountain solution. Suitable fountain solutions include silicone fluids including D4, D5, OS20, OS30, Isopar fluids including Isopar G, L, M and other fluids that: i) are insulative, ii) have low viscosity, for example: less than 10 centipoise, iii) and have low surface energy to facilitate solid dispersion.

Immersion fluid in accordance with embodiments includes a carrier particle or solid particle that carries the dampening fluid. The solid particle need not function to be fixed to a recording medium, and need not be colored. A wide variety of solid particles may be used. For example, silica particles having about a 1 micrometer diameter are suitable. Solid particles that are powder-like, i.e., do not aggregate are preferred for enabling re-use of the solid particles in multiple printing operations.

Immersion fluid in accordance with embodiments includes a charge director, which may be an ionic compound dissolved in the fluid. The charge director gives the solid particles charge. Suitable charge directors include soluble organic aluminum complex.

Systems in accordance with embodiments include an imaging member. The imaging member may be a photoreceptor. The photoreceptor is charged to a uniform voltage for a printing operation at a charging station. An imager comprising a conventional ROS scanner may be implemented and configured to selectively discharge portions of the photoreceptor surface according to image data to generate an electrostatic latent image disposed on the surface of the imaging member.

Systems may include liquid immersion developer operably arranged and configured to apply liquid immersion fluid to a surface of the imaging member. The immersion fluid is applied to the imaging member surface after the electrostatic latent image is produced thereon. In one embodiment, the liquid immersion fluid contains a low concentration of solid particles. For example, an immersion fluid having less than 5% of solid particle by weight in dampening fluid may be used. The low solid concentration fluid may be applied to the imaging member surface having an electrostatic latent image whereby the charged solid particles are attracted to portions of the imaging member according to the electrostatic latent image to develop a liquid immersion fluid image. The developed fluid image may then be developed to achieve a high solid concentration of greater than 20% solid by weight in dampening fluid.

In an alternative embodiment, systems may be configured for applying a high solid concentration immersion fluid for directly developing a high solid concentration fluid image on the imaging member surface. An embodiment of suitable immersion fluid may include a high concentration of solid particles. A preferred image solid concentration for this embodiment is greater than 25%. The high solid concentration immersion fluid may be applied to the charged imaging member surface to form a high solid concentration immersion fluid image that retains its edge for subsequent image transfer. Some air-drying systems may be introduced for applying airflow that removes excess fluid from non-imaged areas of the imaging member surface after liquid immersion fluid development of an electrostatic latent image.

Systems in accordance with embodiments include a transfer member for receiving a fluid from corresponding areas of an imaging member surface having a developed liquid immersion fluid image. The charge directors of the liquid immersion fluid impart electrical charge to the solid particles of the immersion fluid. The solid particles are charged to cause the particles to be attracted to and retained by the imaging member at portions of a surface thereof corresponding to an electrostatic latent image produced by exposing a uniformly charged imaging member. The imaging member may be electrically biased to enhance attraction and retention of solid particles of the immersion fluid on the imaging member surface. In an embodiment, the transfer member may be electrically biased to repel solid particles from a surface thereof at a dampening fluid image loading nip formed by the imaging member and the transfer member. The biased transfer member may enhance retention of solid particles by the imaging member surface at the dampening fluid image loading nip.

Applying an electrical bias to one or both of the imaging member and the transfer member prevents transfer of solid particles from the imaging member to the transfer member during a transfer step of a printing operation. Although transfer of solid particles of the liquid immersion fluid is prevented, transfer of dampening fluid of the immersion fluid is enabled. At the loading nip, as the transfer member surface contacts the imaging member surface, fluid splits from the imaging member surface to form a dampening fluid layer on the transfer member surface that corresponds to the liquid immersion fluid image developed on the imaging member surface. The physic of dampening fluid transfer is similar to liquid toner transfer and contact electrostatic printing, but the electrical bias is applied in reverse, to retain solid particles instead of to transfer solid particles.

In particular, as the liquid immersion fluid developed on the imaging member surface enters the immersion fluid or dampening fluid image loading nip, an electrical field at the nip is weak, and the image comprises a mixture of solid and liquid. In the transfer nip, the electrical field is strong, and it compresses the solid toward the imaging member surface, generating a thin liquid layer between the solid image disposed on the imaging member surface and the transfer member.

At the loading nip exit, the thin fluid layer splits, solid particles of the immersion fluid image being retained on the imaging member surface. The fluid transfers from the imaging member to the transfer member from the solid image to form a dampening fluid image on the transfer member surface. The dampening fluid image has a lower concentration of solid particles than the liquid immersion fluid image. Subsequently, the dampening fluid image may be developed by applying ink to the transfer member surface using an inking system. Either positive or negative images, with respect to the dampening fluid image, may be developed. An optional precure step may be implemented whereby radiation is applied to the developed ink image to increase viscosity or cohesion of the ink in preparation for image transfer. The developed ink image may be transferred to a recording medium that is passed through a transfer nip defined by the transfer member and a transport member. Afterwards the printed image may be further cured.

Ink-based digital printing systems and methods in accordance with embodiments enable reduced risks and costs associated with developing imaging member material sets that satisfy all of IR absorption, dampening fluid, and ink requirements. Further, systems and methods enable improved image quality, print speed, and reduced waste. Systems and methods in accordance with embodiments address process challenges including pull back. In particular, high power laser imaging of related are digital ink-based printing systems cause a rapid expansion of dampening fluid at an imaging point. Further, systems and methods accommodate preferred dampening fluid uniformity. The fluid should be very uniform on a surface of the transfer member. If the dampening fluid layer is about 0.5 micrometers thick, then a 5% tolerance will require the dampening fluid to have less than 25 nm variations, for example. Challenges related to vapor control at an imaging point are obviated. Vaporized dampening fluid may persist in the image area after imaging in related art systems. Vaporized dampening fluid may re-deposit onto the imaging member or neighboring areas. Air flow that is used to counteract vapor can disrupt dampening fluid layer uniformity through flow induced or enhanced evaporation. Air flow around an imaging point must be carefully controlled in related art systems such as those related art systems shown in FIG. 1.

Figure 2:
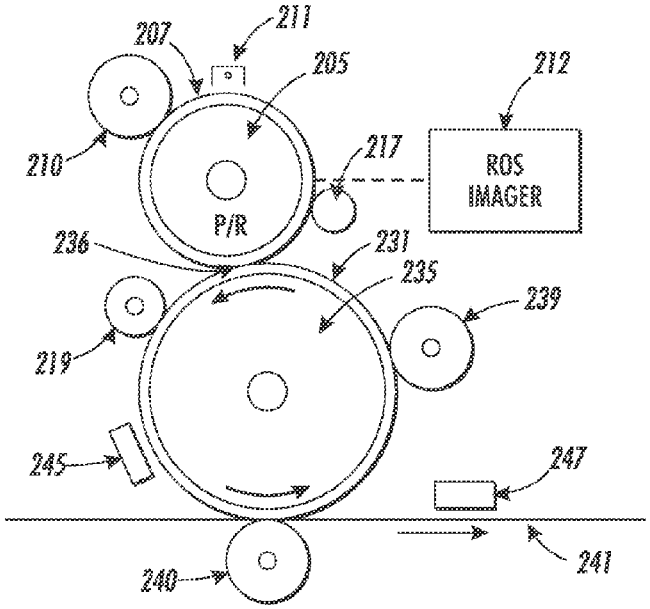
FIG. 2 shows a ink-based digital printing system in accordance with an embodiment.

FIG. 2 shows an ink-based digital printing system in accordance with an embodiment. In particular, FIG. 2 shows an imaging member 205. The imaging member 205 may include a charge-retentive surface 207 configured for being charged to a uniform voltage. In an embodiment, the imaging member surface may comprise silicone elastomers, fluorosilicone elastomers and Viton. Preferably, the imaging member surface 207 may be a photoreceptor. Systems may include a dampening fluid/solid particle removal system 210 disposed adjacent to the imaging member surface 207. Systems may include a charging station 211 arranged and configured for charging the surface 207 of the imaging member 205. Systems may include a raster output scanner ("ROS") or imager 212 configured for selectively exposing a uniformly charged surface according to image data for generating an electrostatic latent image (not shown) on a surface 207 of the imaging member 205.

Systems may include a liquid immersion fluid metering system 217 for presenting a uniform layer of liquid immersion fluid (not shown) onto a surface 207 of the imaging member 205. The liquid immersion fluid is configured to adhere to portions of the imaging member surface 207 according to the electrostatic latent image developed thereon by the ROS imager 212. The liquid immersion fluid comprises dampening fluid and solid particles dispersed therein. Preferably, the immersion fluid comprises a low concentration of solid particles, e.g., less than 5%. For example, the fluid may contain silica particles having a diameter of about 1 micrometer. The liquid immersion fluid includes a charge director dissolved in the fluid for imparting electrical charge to the solid particles. The imaging member 205 may be electrically biased to attract and retain the solid particles of the liquid immersion fluid on the imaging member surface 207.

A transfer member 235 may be configured to form a dampening fluid image loading nip with the imaging member 205. A dampening fluid of the immersion fluid image produced on the liquid immersion fluid metering system 217 and the ROS imager 212 on a region of the imaging member surface 207 is transferred to a transfer member surface 231 under pressure at the loading nip. In particular, a light pressure may be applied between the transfer member surface 231 and the imaging member surface 207. At the dampening fluid image loading nip, the dampening fluid image splits under pressure, and transfer an amount of dampening fluid to the transfer member 235, forming the dampening fluid image. The amount of dampening fluid transferred may be adjusted by contact pressure adjustments. For example, a dampening fluid layer of about 1 micrometer or less may be transferred to the transfer member surface 231.

After the dampening fluid image is transferred to the transfer member 235, ink from an inker 219 is applied to a transfer member surface 231 to form an ink pattern or image. The ink pattern or image may be a negative of or may correspond to the dampening fluid pattern. The ink image may be transferred to media at an ink image transfer nip formed by the transfer member 235 and a substrate transport roll 240. The substrate transport roll 240 may urge a paper transport 241, for example, against the transfer member surface 231 to facilitate contact transfer of an ink image from the transfer member 235 to media carried by the paper transport 241.

Systems may include a rheological conditioning system 245 for increasing a viscosity of ink of an ink image before transfer of the ink image at the ink image transfer nip. Systems may include a curing system 247 for curing an ink image on media after transfer of the ink image from the transfer member 235 to media carried by the paper transport 241, for example. The rheological conditioning system 245 may be positioned before a transfer nip, with respect to a media process direction. The curing system 247 may be positioned after a transfer member 235, with respect to a media process direction. After transfer of the ink image from the transfer member 235 to the media, residual ink may be removed by a transfer member cleaning system 239.

After transfer of the dampening fluid pattern from the imaging member surface 207, the imaging member 205 may be cleaned in preparation for a new cycle by removing dampening fluid and solid particles using the removal system 210. Various methods for cleaning the imaging member surface 207 may be used.

Figure 3:
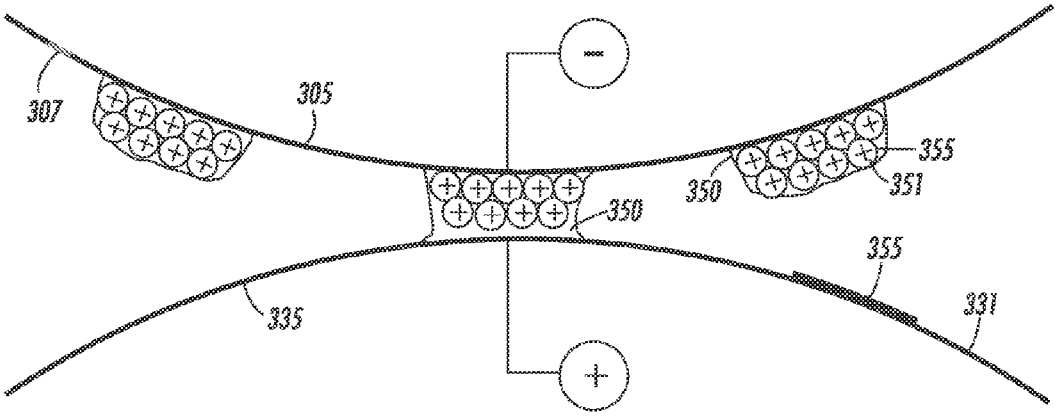
FIG. 3 shows an immersion fluid image loading nip of an ink-based digital printing system in accordance with an embodiment.

Like the imaging member 205, the transfer member 235 may be electrically biased to enhance loading of the dampening fluid image at the loading nip 236. FIG. 3 shows an enlarged view of the loading nip 236 of FIG. 2. In an embodiment, systems may include an imaging member 305 that forms a loading nip with a transfer member 335. FIG. 3 shows liquid immersion fluid 350 disposed on a surface 307 of the imaging member 305 according to an electrostatic latent image produced by an ROS imager. The immersion fluid 350 comprises solid particles 351, which are charged, and dampening fluid 355, which is carried by the solid particles 351. At the loading nip, the dampening fluid forms a fluid layer interposing the imaging member surface 307 and the transfer member surface 331. The imaging member 305 is electrically biased to attract and retain the solid particles to the surface 307 thereof at the loading nip. The transfer member 335 is electrically biased to repel the solid particles toward the imaging member surface 307 and away from the transfer member surface 331, as the dampening fluid layer splits, leaving a uniform layer of dampening fluid 355 on portions of the transfer member surface 331 to form a corresponding dampening layer image.

Figure 4:
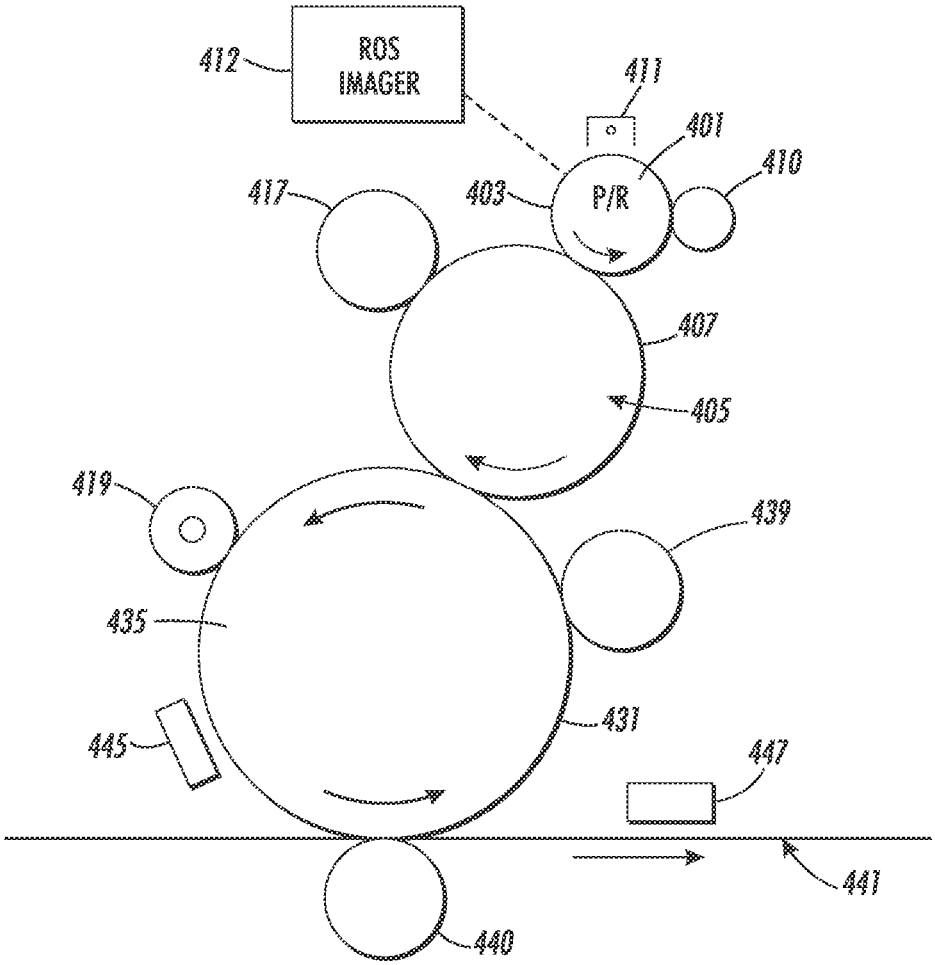
FIG. 4 shows an ink-based digital printing system in accordance with another embodiment.

FIG. 4 shows an ink-based digital printing system in accordance with an alternative embodiment. In particular, FIG. 4 shows a photoreceptor 401 having a charge retentive surface 403. The photoreceptor forms a solid particle transfer nip with an imaging member 405. In an embodiment, the imaging member surface may comprise silicone elastomers, fluorosilicone elastomers and Viton. Systems may include a dampening fluid/solid particle removal system 410 disposed adjacent to the photoreceptor 401. Systems may include an ROS imager 412 configured for selectively exposing a uniformly charged surface 403 of the photoreceptor 401 according to image data for generating an electrostatic latent image (not shown) on a surface 403 of the photoreceptor 401.

Systems may include a liquid immersion fluid metering system 417 for metering a uniform layer of liquid immersion fluid (not shown) onto a surface 407 of the imaging member 405. Solid particles of the liquid immersion fluid are configured to adhere to portions of the photoreceptor surface 403 according to the electrostatic latent image developed thereon by the ROS imager 412. The liquid immersion fluid comprises dampening fluid and a high concentration of solid particles dispersed therein. For example, the fluid may contain silica particles having a diameter of about 1 micrometer. In this embodiment, the immersion fluid may contain a high concentration of solid particles, e.g., greater than 25%. The liquid immersion fluid includes a charge director dissolved in the fluid for imparting electrical charge to the solid particles. As the layer of liquid immersion fluid passes through the image forming nip formed by the imaging member and the photoreceptor, solid particles are removed from the liquid immersion layer, carrying fluid therewith, according to the electrostatic image formed on the photoreceptor 401. The remaining immersion fluid containing solid particles forms the image to be developed using ink.

A transfer member 435 may be configured to form an dampening fluid image loading nip with the imaging member 405. The fluid portion of the immersion fluid image produced on a surface 407 of the imaging member 405 is partially transferred to a transfer member surface 431 under pressure at the dampening fluid image loading nip. In particular, a light pressure may be applied between the transfer member surface 431 and the imaging member surface 407. At the dampening fluid image loading nip, the dampening fluid image splits under pressure, and transfer an amount of dampening fluid to the transfer member 435, forming the dampening fluid image. The amount of dampening fluid transferred may be adjusted by contact pressure adjustments. For example, a dampening fluid layer of about 1 micrometer or less may be transferred to the transfer member surface 431.

After the dampening fluid image is transferred to the transfer member 435, ink from an inker 419 is applied to a transfer member surface 431 to form an ink pattern or image. The ink pattern or image may be a negative of or may correspond to the dampening fluid pattern or image. The ink image may be transferred to media at an ink image transfer nip formed by the transfer member 435 and a substrate transport roll 440. The substrate transport roll 440 may urge a paper transport 441, for example, against the transfer member surface 431 to facilitate contact transfer of an ink image from the transfer member 435 to media carried by the paper transport 441.

Systems may include a rheological conditioning system 445 for increasing a viscosity of ink of an ink image before transfer of the ink image at the ink image transfer nip. Systems may include a curing system 447 for curing an ink image on media after transfer of the ink image from the transfer member 435 to media carried by the paper transport 441, for example. The rheological conditioning system 445 may be positioned before a transfer member nip, with respect to a media process direction. The curing system 447 may be positioned after a transfer member 435, with respect to a media process direction. After transfer of the ink image from the transfer member 435 to the media, residual ink may be removed by a transfer member cleaning system 439.

After transfer of the dampening fluid pattern from the imaging member surface 407, the imaging member 405 may be cleaned in preparation for a new cycle by removing dampening fluid and solid particles using the removal system (not shown). Various methods for cleaning the imaging member surface 407 may be used. The imaging member 405 and/or the transfer member 435 may be electrically biased to enhance dampening fluid transfer and retention of solid particles on the transferring member, imaging member 405.

Figure 5:
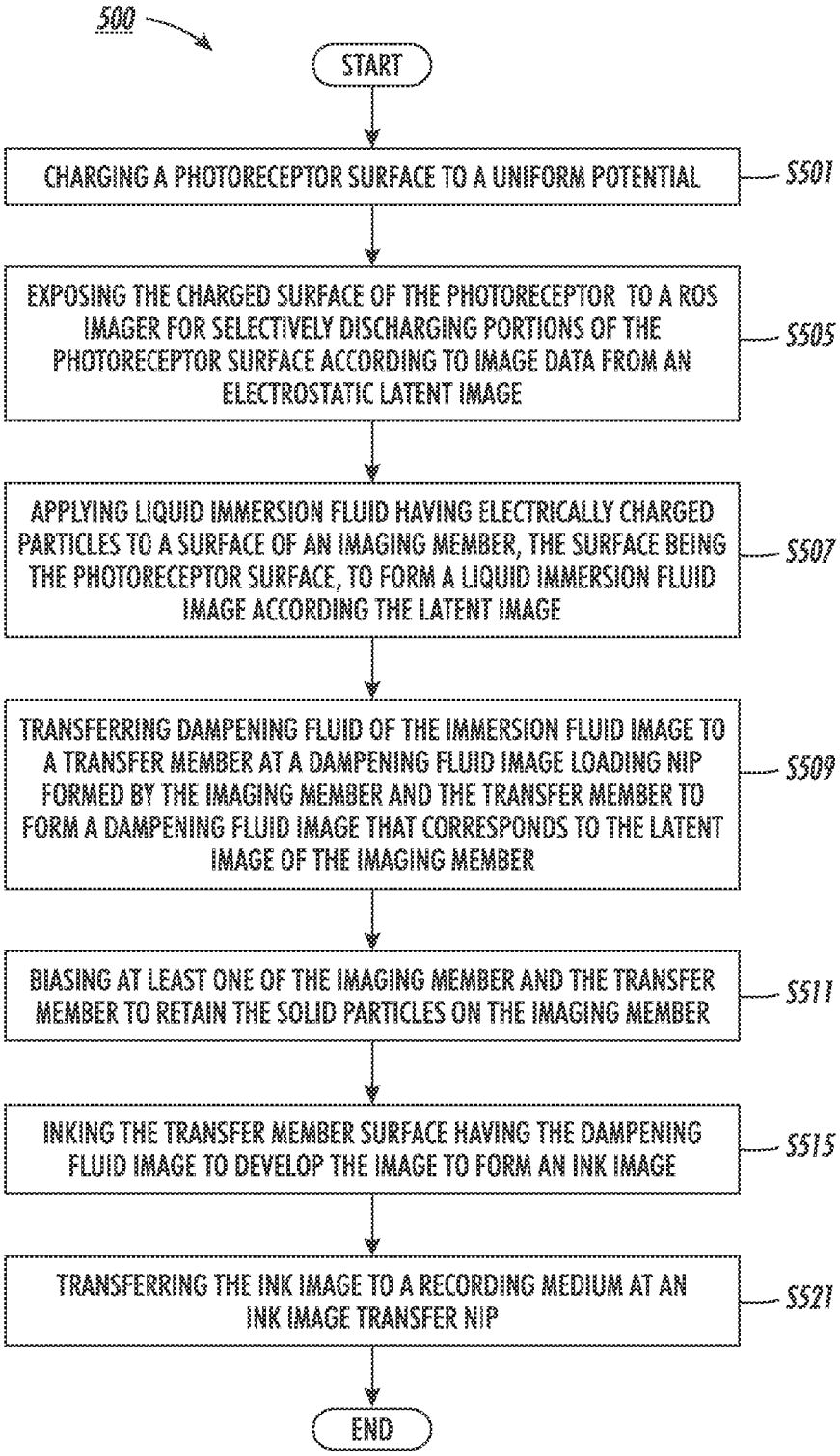
FIG. 5 shows methods of ink-based digital printing in accordance with an embodiment.

FIG. 5 shows methods for ink-based digital printing in accordance with an embodiment. In particular, FIG. 5 shows an ink-based digital printing process 500. Methods may include charging a photoreceptor surface to a uniform potential at S501. The charged surface of the photoreceptor may be exposed at S505 to an ROS imager to selectively discharge portions of the photoreceptor surface according to image data of an image to be printed to form an electrostatic latent image.

Methods may include applying liquid immersion fluid having electrically charged particles to a surface of an imaging member at S507, the surface being the charge retentive surface. A liquid immersion fluid image may thereby be formed on the imaging member surface according to the latent image.

Methods may include transferring dampening fluid of the immersion fluid image to a transfer member at a dampening fluid image loading nip formed by the imaging member and a transfer member at S509. A dampening fluid image thereby be formed that corresponds to the latent image of the imaging member. The dampening fluid image has a lower solid particle concentration than the liquid immersion fluid image.

Methods may include biasing at S511 at least one of the imaging member and the transfer member to retain solid particles on a surface of the imaging member as the dampening fluid is transferred from the imaging member to transfer member. The imaging member may be electrically biased to attract and retain solid charged particles of the liquid immersion fluid and/or the transfer member may be electrically biased to repel solid charged particles during transfer of dampening fluid from the imaging member to the transfer member.

Methods may include inking the transfer member surface having the dampening fluid image at S515. The ink may adhere to portions of the transfer member according to the dampening fluid image. For example, the ink may form a positive or negative image or pattern with respect to the dampening fluid image. Methods may include transferring the ink image to a recording medium at an ink image transfer nip at S521. The transfer nip may be formed by a transfer roll and the transfer member, and may be configured to apply pressure to an interposing recording medium, whether cut sheet or continuous web.

Figure 6:
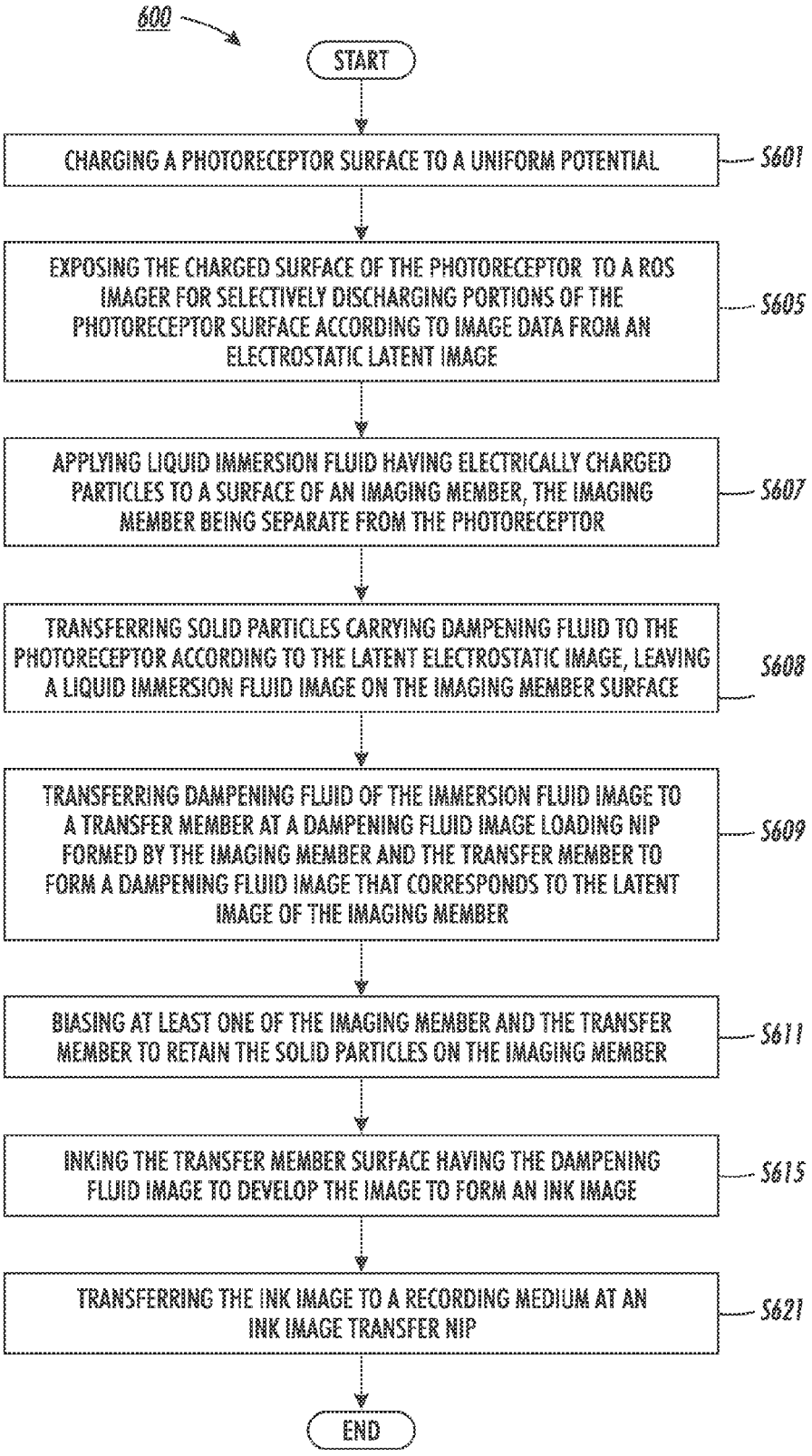
FIG. 6 shows methods of ink-based digital printing in accordance with another embodiment.

FIG. 6 shows methods for ink-based digital printing in accordance with an embodiment. In particular, FIG. 6 shows an ink-based digital printing process 600 that uses a liquid immersion fluid having a high solid particle concentration. Methods may include charging a photoreceptor surface to a uniform potential at S601. The charged surface of the photoreceptor may be exposed at S605 to an ROS imager to selectively discharge portions of the photoreceptor surface according to image data of an image to be printed to form an electrostatic latent image.

Methods may include applying liquid immersion fluid having electrically charged particles to a surface of an imaging member at S607, the surface being separate from the charge retentive surface of the photoreceptor. A liquid immersion fluid image layer may thereby be formed on the imaging member surface. The liquid immersion fluid has a high solid particle content, e.g., greater than 25%. The solid particles are charged, for adhering to desired portions of the photoreceptor surface according to the electrostatic latent image.

Methods may include transferring solid charged particles and associated dampening fluid of the applied liquid immersion fluid at S608 to the photoreceptor having the electrostatic latent image from a surface of the imaging member to generate a liquid immersion fluid image or dampening fluid image on a surface of the imaging member. Solid particles and dampening fluid components of the immersion fluid may be removed from system components after imaging.

Methods may include transferring dampening fluid of the immersion fluid image to a transfer member at a dampening fluid image loading nip formed by the imaging member and a transfer member at S609. A dampening fluid image thereby be formed that corresponds to the latent image of the imaging member. The dampening fluid image has a lower concentration of solid particles than the liquid immersion fluid image formed on the imaging member surface.

Methods may include biasing at S611 at least one of the imaging member and the transfer member to retain solid particles on a surface of the imaging member as the dampening fluid is transferred from the imaging member to the transfer member. The imaging member may be electrically biased to attract and retain solid charged particles of the liquid immersion fluid and/or the transfer member may be electrically biased to repel solid charged particles during transfer of dampening fluid from the imaging member to the transfer member.

Methods may include inking the transfer member surface having the dampening fluid image at S615. The ink may adhere to portions of the transfer member according to the dampening fluid image. For example, the ink may form a positive or negative image or pattern with respect to the dampening fluid image. Methods may include transferring the ink image to a recording medium at an ink image transfer nip at S621. The transfer nip may be formed by a transfer roll and the transfer member, and may be configured to apply pressure to an interposing recording medium, whether cut sheet or continuous web.

Embodiments as disclosed herein may also include computer-readable media for carrying or having computer-executable instructions or data structures stored thereon. Such computer-readable media can be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium which can be used to carry or store desired program code means in the form of computer-executable instructions or data structures. When information is transferred or provided over a network or another communications connection (either hard-wired, wireless, or combination thereof) to a computer, the computer properly views the connection as a computer-readable medium. Thus, any such connection is properly termed a computer-readable medium. Combinations of the above should also be included within the scope of the computer-readable media.

Computer-executable instructions include, for example, instructions and data which cause a general purpose computer, special purpose computer, or special purpose processing device to perform a certain function or group of functions. Computer-executable instructions also include program modules that are executed by computers in stand-alone or network environments. Generally, program modules include routines, programs, objects, components, and data structures, and the like that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described therein.

It will be appreciated that the above-disclosed and other features and functions, or alternatives thereof, may be desirably combined into many other different systems or applications. Also, various presently unforeseen or unanticipated alternatives, modifications, variations or improvements therein may be subsequently made by those skilled in the art.

What is claimed is:

1. An ink-based digital printing system useful for ink printing, comprising:

an imaging member configured for carrying a liquid immersion fluid image on the imaging member;

a transfer member, the imaging member and the transfer member forming a fluid image loading nip, the transfer member being electrically biased to attract or repel a portion of the immersion fluid at the image fluid loading nip during transfer of the immersion fluid from the imaging member to the transfer member;

an immersion metering system comprising a roll for metering a uniform layer of immersion fluid onto a surface of the imaging member to form the immersion fluid image;

an inking system, the inking system being configured to apply ink to the fluid image on the surface of the transfer member for developing the fluid image, wherein the immersion fluid comprises:

a dampening fluid; solid particles dispersed in the dampening fluid; and a charge director for imparting charge to the solid particles to enable transfer of the immersion fluid image.

2. The system of claim 1, the liquid immersion fluid of the liquid immersion fluid image having dampening fluid and solid particles, the system comprising the imaging member and the transfer member being configured to transfer at least a portion of the dampening fluid of the liquid immersion fluid image to a surface of the transfer member at the fluid image loading nip to form a dampening fluid image on the transfer member surface.

3. The system of claim 1, the liquid immersion fluid comprising:

a dampening fluid selected from the group consisting essentially of silicone fluids (including D4, D5, OS20, OS30), Isopar fluids; and solid silica particles, the solid particles being dispersed in the dampening fluid.

4. The system of claim 1, the imaging member comprising:

a surface selected from the group consisting essentially of silicone elastomers, fluoro silicone elastomers, and Viton.

5. The system of claim 1, at least one of the imaging member and the transfer member being electrically biased for retaining the solid particles on the imaging member surface.

6. The system of claim 1, the imaging member being a photoreceptor, and the immersion fluid image being formed on the imaging member according to an electrostatic latent image formed on the imaging member.

7. The system of claim 6, comprising:

a raster output scanner imager, the imager being configured to expose a surface of the imaging member to selectively discharge portions of the imaging member according to image data to form an electrostatic latent image.

8. The system of claim 6, comprising:

a liquid immersion fluid metering system, the liquid immersion fluid system being configured to present a uniform layer of liquid immersion fluid to a surface of the imaging member for causing the fluid to adhere to the imaging member surface according to the latent image to form the immersion fluid image.

9. The system of claim 1, comprising:

a photoreceptor member, the photoreceptor member being configured for forming an electrostatic latent image on a surface of the photoreceptor member, the photoreceptor member and the imaging member being configured to form a solid particle transfer nip for transfer of solid particles from the imaging member to the photoreceptor member according to the electrostatic latent image.

10. The system of claim 9, comprising:

a liquid immersion fluid metering system for presenting a uniform layer of liquid immersion fluid to a surface of the imaging member, the photoreceptor member removes immersion fluid in selected regions from the imaging member according to the electrostatic latent image, the immersion fluid that remains on the imaging member forms the immersion fluid image on the imaging member.

11. The system of claim 9, comprising:

a raster output scanner imager, the imager being configured to expose a surface of the photoreceptor to selectively discharge portions of the photoreceptor according to image data to form an electrostatic latent image.

12. A method of ink-based digital printing using liquid immersion fluid, comprising:

forming a liquid immersion fluid image on an imaging member using an imaging fluid metering system, the imaging fluid metering system comprising a roll, the liquid immersion fluid comprising dampening fluid and solid particles dispersed in the dampening fluid;

transferring a portion of a dampening fluid of the immersion fluid image to a transfer member at a fluid image loading nip formed by the transfer member and the imaging member;

forming an electrostatic latent image on a surface of a photoreceptor forming a solid particle transfer nip with the imaging member; and transferring at least a portion of the solid particles of the uniform layer to the photoreceptor according to the latent image on the photoreceptor at the solid particle transfer nip to form the liquid immersion fluid image on the imaging member by electrically biasing the imaging member to cause the imaging member to repel or attract a portion of the immersion fluid.

13. An ink-based digital printing system useful for ink printing, comprising:

an imaging member configured for forming a liquid immersion fluid image on the imaging member, the liquid immersion fluid comprising dampening fluid and solid particles dispersed in the dampening fluid, the immersion fluid being metered by a roll of an imaging fluid metering system;

a transfer member configured for transferring the immersion fluid image from the imaging member to the transfer member at a fluid image loading nip formed by the transfer member and the imaging member, the transfer member being electrically biased to facilitate transfer of the immersion fluid image and formation of the immersion fluid image on the transfer member; and an inking system, the inking system being configured to develop the transferred immersion fluid image on the transfer member by applying ink to the immersion fluid image.

14. The ink-based digital printing system of claim 13, comprising:

an imager system for forming an electrostatic latent image a surface of the imaging member according to image data; and a liquid immersion fluid metering system configured for presenting liquid immersion fluid to the imaging member surface to form a fluid image according to the latent image.

15. The system of claim 13, comprising at least one of the imaging member and the transfer member being electrically biased.

16. The system of claim 13, comprising:

an imager system for forming an electrostatic latent image on a surface of a photoreceptor according to image data, the photoreceptor forming a solid particle transfer nip with the imaging member; and a liquid immersion fluid system configured for presenting liquid immersion fluid to the imaging member to form a uniform layer of liquid immersion fluid, wherein the photoreceptor and the imaging member are configured for transferring at least a portion of the solid particles of the uniform layer to the photoreceptor according to the latent image on the photoreceptor at the solid particle transfer nip to form the liquid immersion fluid image on the imaging member.

* * * * *